US006640495B1

(12) United States Patent
McKernan

(10) Patent No.: US 6,640,495 B1
(45) **Date of Patent: *Nov. 4, 2003**

(54) SAFETY HATCH FOR PREVENTING FALL-THROUGH AND UNAUTHORIZED ENTRY

(75) Inventor: Timothy J. McKernan, Baldwinsville, NY (US)

(73) Assignee: Syracuse Castings Sales Corp., Cicero, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/235,107

(22) Filed: Jan. 21, 1999

(51) Int. Cl.[7] ..... E05B 65/04

(52) U.S. Cl. ..... 49/67; 49/68; 49/142; 49/400

(58) Field of Search ..... 49/68, 61, 63, 49/67, 142, 207, 366, 371, 400, 56, 254, 255, 257, 258, 259, 260, 261, 276; 404/25, 26; 16/319, 363; 52/19; 292/95, 100, 101, 200, 202

(56) References Cited

U.S. PATENT DOCUMENTS

| | | | | | |
|---|---|---|---|---|---|
| 14,107 | A | | 1/1856 | Moore | |
| 14,359 | A | | 3/1856 | Jenks | |
| 124,242 | A | | 3/1872 | Ashcroft | |
| 195,965 | A | | 10/1877 | Straight | |
| 202,373 | A | | 4/1878 | Purtell | |
| 471,947 | A | * | 3/1892 | Callahan | 49/31 |
| 705,679 | A | | 7/1902 | Knapp et al. | |
| 727,860 | A | * | 5/1903 | Swope | 49/53 |
| 736,714 | A | | 8/1903 | Gendron | |
| 916,803 | A | * | 3/1909 | Triggs | 49/402 |
| 934,726 | A | * | 9/1909 | Henry | 126/94 |
| 951,280 | A | * | 3/1910 | Jones | 49/208 |

(List continued on next page.)

FOREIGN PATENT DOCUMENTS

| | | | | |
|---|---|---|---|---|
| DE | 3843680 | * | 7/1990 | 49/260 |
| DE | 3941708 | * | 6/1991 | 52/19 |

(List continued on next page.)

OTHER PUBLICATIONS

Syracuse Castings Catalog, shows various access hatch configurations, no date.

*Primary Examiner*—Gregory J. Strimbu
(74) *Attorney, Agent, or Firm*—Duane Morris LLP

(57) ABSTRACT

An access hatch comprises a frame, a grate, and a pull member pivotally coupled to the grate. The frame contains an access opening. The grate has a near side and a far side. The near side is coupled to the frame for pivotal movement of the grate between a closed and an open position. In the closed position, the grate lies substantially in the access opening of the frame and blocks at least a portion of the opening. In the open position, the grate is oriented away from the opening of the frame to allow access through the opening. The pull member has a proximal end and a distal end. The distal end is pivotally coupled to the grate near the far side of the grate, such that the proximal end is moveable away from the grate from a rest position. The proximal end extends substantially to the near side of the grate when the proximal end is in the rest position. The proximal end is normally in the rest position when the grate is in the closed position. A worker, intending to open the grate, is prompted to stand at the near side of the grate and grasp the proximal end of the pull member, to pull the grate to the open position.

29 Claims, 7 Drawing Sheets

U.S. PATENT DOCUMENTS 1,066,736 A * 7/1913 Kurz ..... 49/261
1,068,856 A 7/1913 Clay
1,087,243 A * 2/1914 Kurz ..... 49/260
1,120,943 A * 12/1914 Kirn ..... 292/228
1,244,501 A 10/1917 Jackson
1,442,737 A 1/1923 Schacht
1,473,986 A * 11/1923 Brown ..... 70/169
1,475,199 A * 11/1923 Rust ..... 49/465
1,523,191 A 1/1925 Gilfoy
1,529,601 A * 3/1925 Lyons ..... 49/197
1,554,366 A * 9/1925 Raber ..... 49/402
1,601,647 A * 9/1926 Rose ..... 292/218
1,799,123 A * 3/1931 Robertson ..... 49/53
1,941,589 A * 1/1934 Wellons ..... 292/95
2,038,876 A * 4/1936 Sonabend ..... 292/218
2,124,696 A 7/1938 Hall
2,295,827 A * 9/1942 Breen et al. ..... 49/276
2,610,084 A * 9/1952 Anderson ..... 49/460
2,627,950 A * 2/1953 Dath ..... 49/276
3,198,094 A 8/1965 Dunkerley
3,521,537 A 7/1970 Forni et al.
3,788,689 A * 1/1974 Lloyd ..... 292/304
4,266,380 A 5/1981 Samolis
4,508,469 A * 4/1985 Dumortier ..... 404/25
4,534,132 A * 8/1985 Smith ..... 49/386
4,649,599 A * 3/1987 Beller ..... 16/332
4,710,590 A * 12/1987 Ekdahl ..... 174/35 GC
4,895,007 A * 1/1990 Eberly ..... 70/54
4,993,187 A * 2/1991 Schweiss et al. ..... 49/56
5,016,393 A * 5/1991 Weinerman ..... 49/395
5,050,944 A * 9/1991 Fricano ..... 312/323
5,054,723 A * 10/1991 Arnold ..... 248/65
5,160,213 A * 11/1992 Spiess et al. ..... 404/25
5,241,789 A 9/1993 Vacelet
5,265,974 A 11/1993 Dargie
5,433,131 A * 7/1995 Suzuki ..... 84/179
5,562,316 A * 10/1996 Bullock et al. ..... 292/202
5,709,155 A * 1/1998 Terracciano ..... 108/42
5,873,355 A * 2/1999 Schlosser et al. ..... 126/41 R
5,941,024 A * 8/1999 Journault ..... 52/20

FOREIGN PATENT DOCUMENTS

DK 25840 * 4/1920 ..... 49/260
DK 51649 * 5/1936 ..... 292/101
EP 558 * 2/1872 ..... 52/19
EP 741835 * 12/1955 ..... 49/260
EP 420777 * 4/1991 ..... 52/19
FR 2424372 * 12/1979 ..... 292/101
NO 43034 * 8/1926 ..... 49/260
SE 80023 * 4/1934 ..... 49/260

* cited by examiner

SAFETY HATCH FOR PREVENTING FALL-THROUGH AND UNAUTHORIZED ENTRY

BACKGROUND OF THE INVENTION

1. Technical Field

The present invention relates generally to hatches and similar apparatus for controlling access to installations such as submersible pump stations, pits, sewers, manholes, vaults, cellars, chutes, chambers, large receptacles, confined spaces, and the like. The present invention relates more particularly to a hatch which includes certain safety features to protect against a fall through the hatch and prevent unauthorized entry to a confined space.

2. Background Art

Access hatches and similar devices have been in use, in one form or another, for hundreds of years. A representative sample of such devices are disclosed in the following United States Patents: U.S. Pat. No. 4,266,380 to Samolis (1981); U.S. Pat. No. 3,521,537 to Forni et al. (1970); U.S. Pat. No. 3,198,094 to Dunkerley (1965); U.S. Pat. No. 1,523,191 to Gilfoy (1925); U.S. Pat. No. 1,442,737 to Schacht (1923); U.S. Pat. No. 1,244,501 to Jackson (1917); U.S. Pat. No. 1,068,856 to Clay (1913); U.S. Pat. No. 736,714 to Gendron (1903); U.S. Pat. No. 705,679 to Knapp et al. (1902); U.S. Pat. No. 202,373 to Purtell (1878); U.S. Pat. No. 195,965 to Straight (1877); U.S. Pat. No. 14,359 to Jenks (1856); and U.S. Pat. No. 14,107 to Moore (1856).

The hatches disclosed in these patents all present a potential safety hazard, in that the worker is usually exposed to an open hole when he or she is opening or closing the hatch door, cover, grate, etc. For example, to open or close the hinged grates in U.S. Pat. No. 4,266,380 to Samolis, the worker has to grasp the free side (opposite the hinged side) of the grate. This arrangement encourages the worker to stand near the free sides of the grates or to reach over the grates, exposing the worker to the hole as the grates are opened. A similar example is shown in U.S. Pat. No. 736,714 to Gendron—the handle is located at the free side of the door. A different example is shown in U.S. Pat. No. 3,198,094 to Dunkerley, where a handle to a door lever is located at the free side of a hinged door. The position of the handle encourages the worker to stand near or reach over to the free side of the door, thus exposing the worker to the risk of a fall. Thus, a need persists to improve upon the safety of hatches, especially during the process of opening and closing the hatches.

Another safety issue presented by hatches concerns the requirement that an adequate barrier be erected around the hatch opening. A number of attempts have been made to incorporate such a barrier into the hatch design itself, to eliminate the need for a separate barrier. Examples of such attempts are disclosed in the following U.S. Patents: U.S. Pat. No. 5,241,789 to Vacelet (1993); U.S. Pat. No. 4,266,380 to Samolis; U.S. Pat. No. 1,442,737 to Schacht; U.S. Pat. No. 1,244,501 to Jackson; U.S. Pat. No. 705,679 to Knapp et al.; U.S. Pat. No. 195,965 to Straight; U.S. Pat. No. 14,359 to Jenks; and U.S. Pat. No. 14,107 to Moore. Some of these designs have met with some success. However, they suffer from certain drawbacks. Some of these designs require an interconnection, by way of fasteners, clips or chains, between the "barrier components" (e.g., plates or grates) and the hatch cover. This arrangement creates the possibility that if such an interconnection fails, the entire barrier may fail. Fasteners, clips and chains are prone to failure over the useful life of the hatch. Another drawback is the complexity of the moving parts associated with the barrier components and the increased complexity of the hatch cover design. Such complexity leads to increased costs, maintenance and repair for the hatch. Thus, there is a need for a simple, reliable, and inexpensive approach to providing a barrier function in a hatch design.

Another safety issue is whether protection is afforded a worker against falling through the hatch opening (i.e., "fall-through protection"). A falling hazard can arise even where the hatch provides some means of fall-through protection. For example, U.S. Pat. No. 5,265,974 (1993) to Dargie describes a "safety net" for the hatch opening. Such a device may be adequate to prevent a fall through the hatchway. However, the net is to be pushed aside, like a shower curtain, to gain access through the hatch. The worker could inadvertently leave the net open after work is completed and the hatch is closed, thus creating a hazard to the next worker who opens the hatch. Thus, a need exists for fall-through protection that is less prone to human error.

The hazard of falling through a hatchway can be further reduced if the worker can perform certain work while the existing fall-through protection is in-place. Such an objective can be achieved if the fall-through protection permits limited access through the hatch. Also, in cases where apparatus connected to a utility line (e.g., a cable or hose) is to be brought up through the hatch for maintenance, the above objective can be achieved with fall-through protection that can be put back in-place once the apparatus is brought up for maintenance. The patents cited herein fail to address such additional versatility in fall-through protection for hatches.

There are instances when a worker may only need to look through a hatch and not enter through it. For example, a worker may need only to visually inspect equipment installed in a pit. In such a case, a worker, who is not trained or certified to enter the pit, can be assigned to such duties. However, once the hatch cover is opened, the untrained or uncertified worker may be tempted to enter the pit. It would therefore be advantageous to provide direct means for controlling the removal of the fall-through protection (e.g., the opening of a grate). For example, for a hatch having a cover and grate, a lock can be employed separately for the grate. An untrained or uncertified worker would be denied access to a key for the grate, thus preventing unauthorized entry.

OBJECTS AND SUMMARY OF THE INVENTION

It is therefore an object of the present invention to provide an access hatch that avoids the limits and problems associated with the prior art.

It is another object of the present invention to provide an access hatch that prompts a worker to stand at a safe location when opening and closing the hatch.

It is a further object of the present invention to provide an access hatch with a grate, wherein the grate self-locks in an open position to provide a secure barrier on one side of the hatch.

It is yet another object of the present invention to provide an access hatch with a grate, wherein a simple self-locking hinge is provided to lock the grate in an open position.

It is yet a further object of the present invention to provide an access hatch with fall-through protection that is substantially immune from human error.

It is still another object of the present invention to provide an access hatch with fall-through protection, wherein the fall-through protection must be in-place before the hatch cover can be closed by a worker, thus ensuring that the fall-through protection is in place for the next worker who opens the hatch.

It is still a further object of the present invention to provide limited access through the hatch even though fall-through protection is in place, thus allowing a worker to perform minor maintenance tasks without removing the fall-through protection.

It is yet still another object of the present invention to provide an access hatch with fall-through protection that can be put back in-place once apparatus, connected to a utility line (e.g., a cable or hose), is brought up through the hatch for maintenance.

It is yet still a further object of the present invention to provide an access hatch with fall-through protection, wherein direct means are provided for controlling the removal of the fall-through protection, to prevent unauthorized entry.

These and other objects are attained in accordance with the present invention, wherein there is provided an access hatch having a frame, a grate, and a pull member or arm pivotally coupled to the grate. The frame contains an access opening. The grate has a near side and a far side. The near side is coupled to the frame for pivotal movement of the grate between a closed and an open position. In the closed position, the grate lies substantially in the access opening of the frame and blocks at least a portion of the opening. In the open position, the grate is oriented away from the opening of the frame to allow access through the opening. The pull member has a proximal end and a distal end. The distal end is pivotally coupled to the grate, near the far side of the grate, such that the proximal end is moveable away from the grate from a rest position. The proximal end extends substantially to the near side of the grate when the proximal end is in the rest position. The proximal end is normally in the rest position when the grate is in the closed position. A worker, intending to open the grate, is prompted to stand at the near side of the grate and grasp the proximal end of the pull member, to pull the grate to the open position.

In the preferred embodiment, the access hatch further comprises a cover mounted to the frame for pivotal movement between an open position (away from the frame) and a closed position (over the frame). The grate and cover are disposed on the frame such that movement of the cover, from the open to the closed position, is obstructed by the grate when the grate is in the open position, and is clear of the grate when the grate is in the closed position. Thus, the cover cannot be closed until the grate is closed.

In the preferred embodiment, the pull member includes a catch extending from its distal end. The catch is adapted to engage the frame when the grate is in the closed position and the pull member is in the rest position. This engagement locks the grate in the closed position. The pull member may further include an eyelet at its proximal end, to receive a fastener, such as a padlock. In this case, the grate contains a hole which is aligned with the eyelet when the pull arm is in the rest position. The padlock or other fastener is inserted through the aligned hole and eyelet to lock the pull arm to the grate.

In the preferred embodiment, the grate is coupled to the frame by way of a locking hinge. The hinge includes a male link member coupled to a female link member. One of the link members is rotatable relative to the other of the link members. The male link member lockingly engages the female link member at a locking point of rotation. The link members are oriented relative to the frame and grate such that the locking point of rotation occurs when the grate is in the open position. The grate is locked in the open position upon engagement of the male and female link members.

In the preferred embodiment, the near side of the grate is spaced apart from the frame so as to define a limited access opening between the frame and grate. This allows limited access through the grate when the grate is in the closed position.

In the preferred embodiment, the grate includes a perimeter containing a recessed portion. The recessed portion forms a utility opening with the frame when the grate is in the closed position. An apparatus connected to a utility line can pass through the access opening when the grate is in the open position, and rest on top of the grate when the grate is in the closed position. This is possible because the utility line is able to pass through the utility opening.

The present invention also contemplates a hatch with more than one grate and cover. In a preferred embodiment, a pair of grates and corresponding covers are employed. In such an embodiment, a utility opening may be defined by two complementary recesses, one contained in each grate. Alternatively, the utility opening may be defined by two complementary recesses and the frame.

BRIEF DESCRIPTION OF THE DRAWING

Further objects of the present invention will become apparent from the following description of the preferred embodiments with reference to the accompanying drawing, in which.

DESCRIPTION OF THE PREFERRED EMBODIMENT

Figure 1:
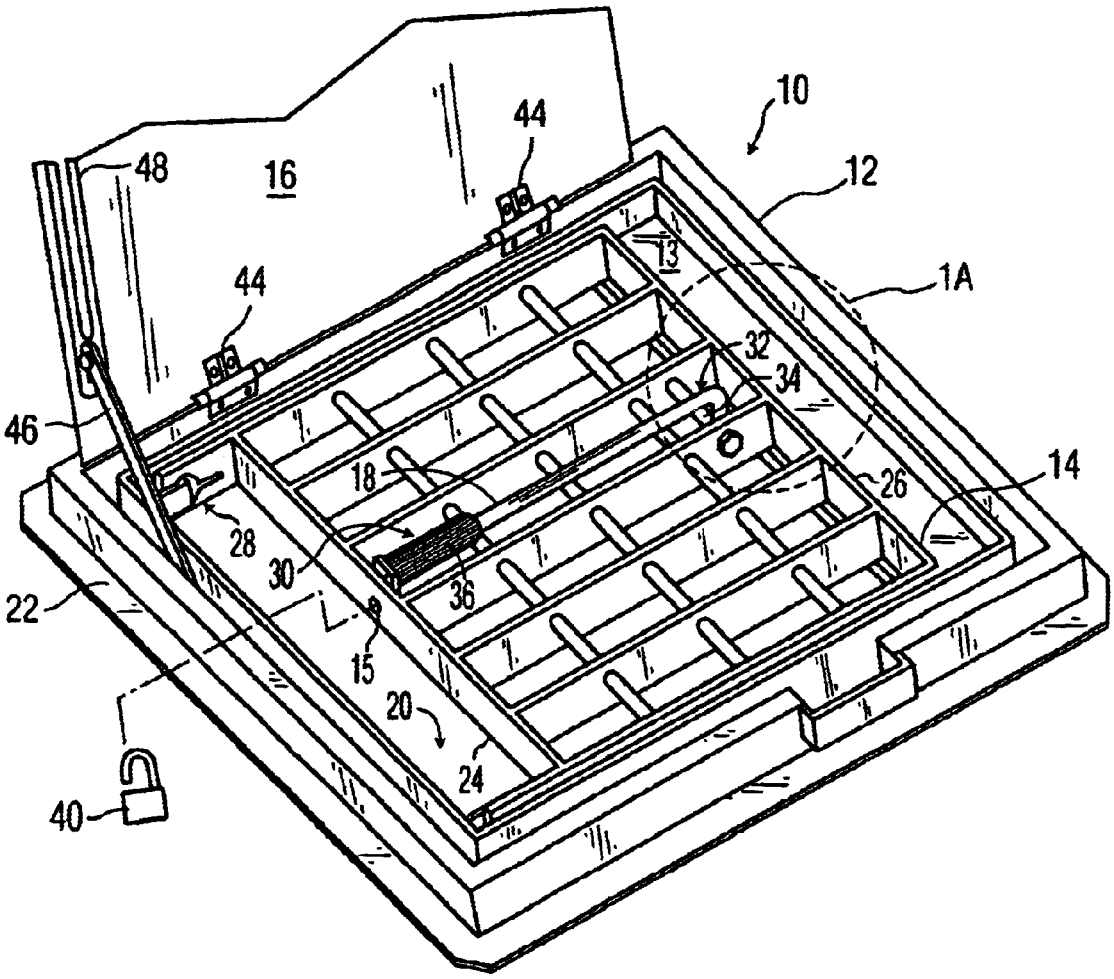
FIG. 1 is a perspective view of a single-leaf access hatch, constructed in accordance with the present invention.

Referring now to FIG. 1, there is shown a single-leaf access hatch 10, constructed in accordance with the present invention. Hatch 10 comprises a channel-type frame 12, a grate 14, a cover 16, and a pull arm 18. Frame 12 contains an access opening 20 and an anchor flange 22. The present invention is not limited to a channel-type frame; for example, an angle-type frame is also suitable. Frame 12 functions as the foundation for hatch 10 and, upon installation, is held in place by a concrete slab poured around the frame. Frame 12 may be made of extruded aluminum.

Grate 14 (sometimes referred to as a "safety grate") has a near (or hinged) side 24 and a far (or free) side 26. Near side 24 is pivotally coupled to frame 12 by way of a pair of locking hinges 28 (See also FIGS. 3–5). Hinges 28 permit pivotal movement of grate 14 between a closed position (shown in FIG. 1) and a locked open position (shown in FIG. 6C and FIG. 8). In the closed position, grate 14 lies substantially in the plane of access opening 20 and blocks the opening (FIG. 1). In the open position, grate 14 is oriented away from opening 20 to allow access through the opening. Once grate 14 is brought up to the open position (FIG. 6C), it locks in place and provides a secure barrier between the worker and hatch opening 20.

Grate 14 may be made from aluminum bar stock. As shown in FIG. 1, both round and rectangular bar stock may be used. The grate openings (i.e., the openings formed by the grid of bars) should be about 5×5 inches to allow for visual inspection through the grate. For many applications, grate 14 should be designed to withstand a minimum live load of 300 pounds per square foot, and the deflection should not exceed $1/150^{th}$ of the span.

Figure 1A:
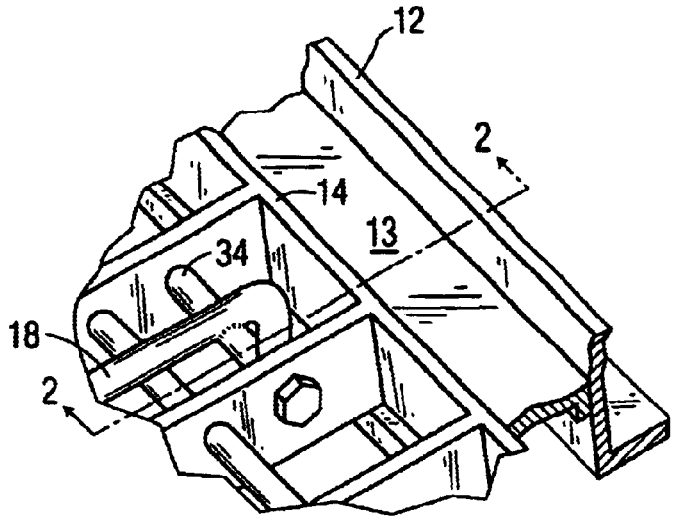
FIG. 1A is an enlarged fragmentary view of a circled area 1A in FIG. 1, which focuses on a pivot pin connection of a pull arm to a grate in the access hatch.
Figure 1B:
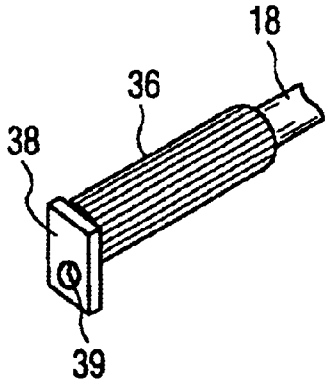
FIG. 1B is an enlarged fragmentary view of the handle portion of the pull arm.
Figure 2:
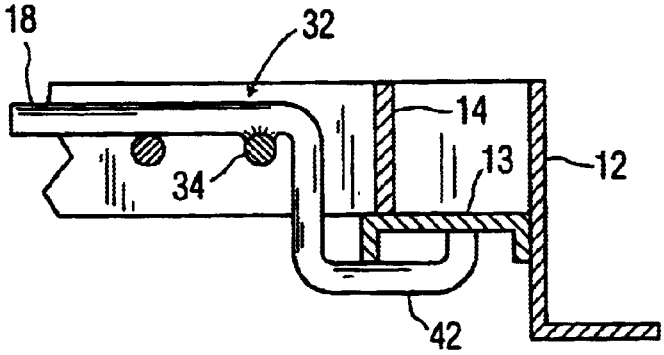
FIG. 2 is a cross-sectional view, taken along line 2—2 in FIG. 1A, illustrating the checking engagement of a catch with the hatch frame.
Figure 3:
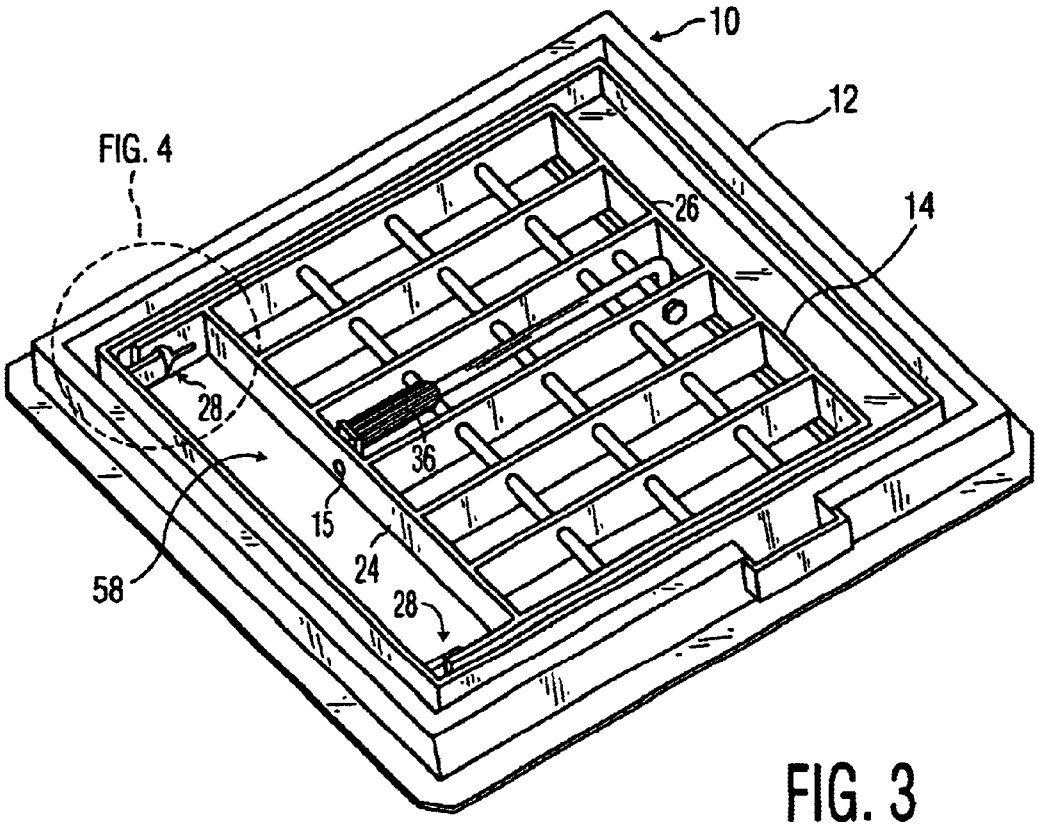
FIG. 3 is a perspective view of the access hatch of FIG. 1, without the hatch door, showing a circled area which focuses on a locking hinge coupling the grate to the frame.

As shown in FIG. 1, pull arm 18 has a proximal end 30 and a distal end 32. Distal end 32 is pivotally coupled to grate 14 by way of a hinge bar or pin 34 rotatably mounted in the grate (See also FIGS. 1A and 2). At proximal end 30, pull arm 18 has a vinyl grip handle 36 (FIG. 1B). Preferably, handle 36 has a conspicuous color, such as red or orange, to immediately alert a worker of the handle. In FIG. 1, pull arm 18 is shown in a "rest position." Pull arm 18 is normally in the rest position when grate 14 is in the closed position. In the rest position, proximal end 30 extends substantially to near side 24 of grate 14 (FIGS. 1 and 3). Proximal end 30 is manually moveable away from grate 14, from the rest position, because of rotatable hinge bar 34.

As shown in FIG. 1B, pull arm 18 also has an eyelet member (or "padlock clip") 38 containing an eyelet or bore 39. As shown in FIG. 1, grate 14 contains a hole 15. The bore of eyelet member 38 aligns with hole 15 when pull arm 18 is in the rest position. This allows for a padlock 40, or some other locking fastener, to be inserted through aligned hole 15 and bore 39 (FIG. 1), to lock pull arm 18 to grate 14. As shown in FIG. 2, pull arm 18 further includes a catch 42 extending from distal end 32. Catch 42 engages (or nearly engages) frame 12 when grate 14 is in the closed position and pull member 18 is brought to the rest position (FIG. 2). Frame 12 includes a channeled rail 13 (which is preferably a uni-strut nut rail) with which catch 42 actually engages. Rail 13 provides a bearing or supporting surface for the free end of grate 14 (See FIG. 2). Catch 42 functions to check the movement of grate 14 when the grate is in the closed position and pull member 18 is in the rest position. When pull arm 18 is locked to grate 14 with padlock 40, the grate will be locked in the closed position, thus preventing unauthorized entry through hatch 10.

As shown in FIG. 1, cover 16 is mounted to frame 12 by a pair of hinges 44. Hinges 44 are bolted to cover 16 and frame 12. Hinges 44 permit pivotal movement of cover 16 between an open position (FIG. 1) and a closed position (over the frame) where cover 16 covers frame opening 20. Cover 16 is supported in the open position by a "hold open arm" 46. Arm 46 is rotatably bolted to frame 12 at one end and slidably engages a track 48 at the other end. Track 48 is welded to cover 16. In the preferred embodiment, the open position for cover 16 is approximately 90 degrees from the plane of frame opening 20. Cover 16 may be made of ¼ inch diamond plate aluminum. Cover 16 may be supplied with a slam lock (not shown), or other locking mechanism, for locking the cover to the frame or grate. Cover 16 may also be equipped with a flush lift handle (not shown) on the top of the cover.

Figure 4:
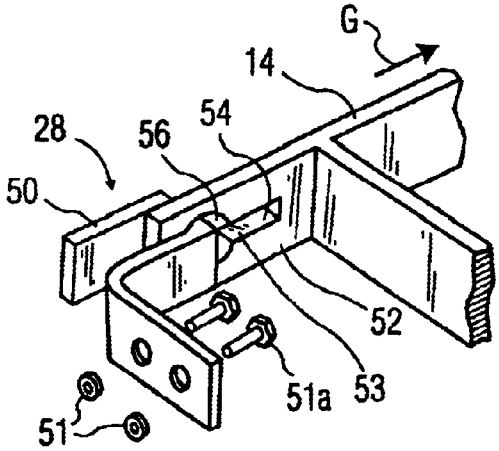
FIG. 4 is an enlarged fragmentary view of the circled area in FIG. 3, showing the locking hinge in a closed position.
Figure 5:
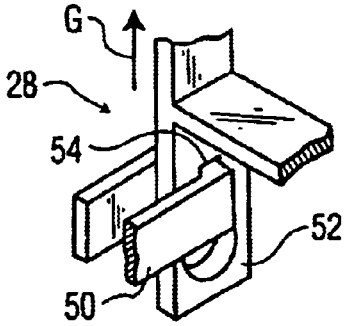
FIG. 5 is an enlarged fragmentary view of the circled area in FIG. 3, showing the locking hinge in an open and locked position.

Referring now to FIGS. 3–5, locking hinges 28 will now be described in greater detail. As shown in FIG. 3, there is a pair of identical locking hinges 28 which couple grate 14 to frame 12. Each locking hinge includes a male link member 50 coupled to a female link member 52 (FIGS. 4 and 5). In the embodiment shown, link member 50 is securely bolted to frame 12 with a pair of nuts and bolts 51 and 51*a*. Alternatively, link 50 can be welded to frame 12. In the embodiment shown, link member 52 is an integral extension of grate 14. As best shown in FIG. 4, female link member 52 contains a key-shaped hole 53 having a slotted section 54 and a circular section 56. The diameter of circular section 56 is large enough to permit link member 52 to rotate about link member 50, for at least 90 degrees of rotation.

In FIG. 4, the orientation of link 52 relative to link 50 is defined as the "zero degree point of rotation." At this point of rotation, grate 14 is in the closed position. In FIG. 5, the orientation of link 52 relative to link 50 is defined as the "90 degree point of rotation." At this point of rotation, grate 14 is in the open position. At the 90 degree point of rotation, link 50 is able to engage slotted section 54. Such engagement occurs as grate 14 drops due to gravity or a slight downward push of the grate by a worker. The engagement of links 50 and 52 (FIG. 5), at both hinges, causes grate 14 to be locked in the open position (See FIG. 6C). The point of rotation where such locking engagement occurs is called the "locking point of rotation." Grate 14 is unlocked from the open position by raising the grate, which disengages link 50 from link 52. Upon disengagement, grate 14 is free to pivot between the open and closed positions.

In FIGS. 4 and 5, arrow G indicates the position of grate 14, where the closed position is indicated in FIG. 4 and the open position is indicated in FIG. 5.

Referring now to FIG. 3, near side 24 of grate 14 is spaced apart from frame 12, so as to define a limited access opening 58. Preferably, near side 24 is spaced apart from frame 12 by about 4½ to 5 inches. Opening 58 enhances visual inspection through the grate. In addition, opening 58 allows a worker to reach through grate 14 to perform certain adjustments or maintenance to apparatus, without opening the grate (i.e., without removing the fall-through protection). In some cases, certain apparatus can be brought up through opening 58 for repair or adjustment outside the installation (without opening the grate).

Figure 6A:
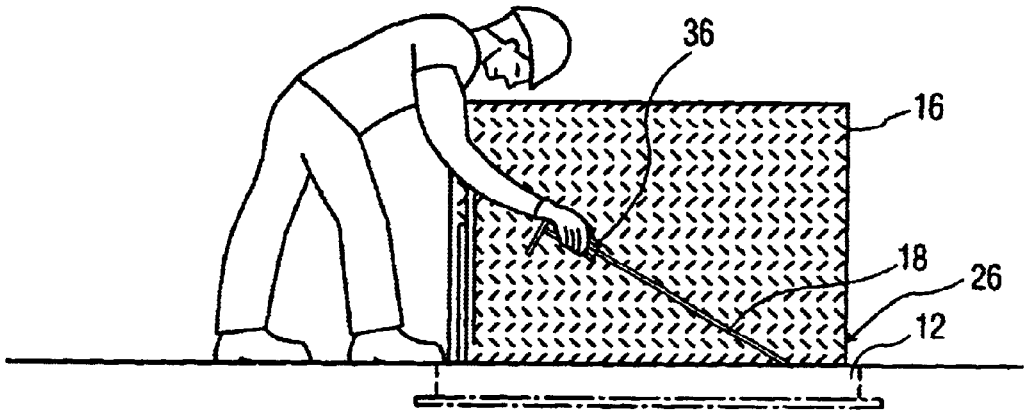
FIG. 6A is diagrammatic view, illustrating how the pull arm prompts a worker to stand at a safe location while opening or closing the grate of FIG. 1.
Figure 6B:
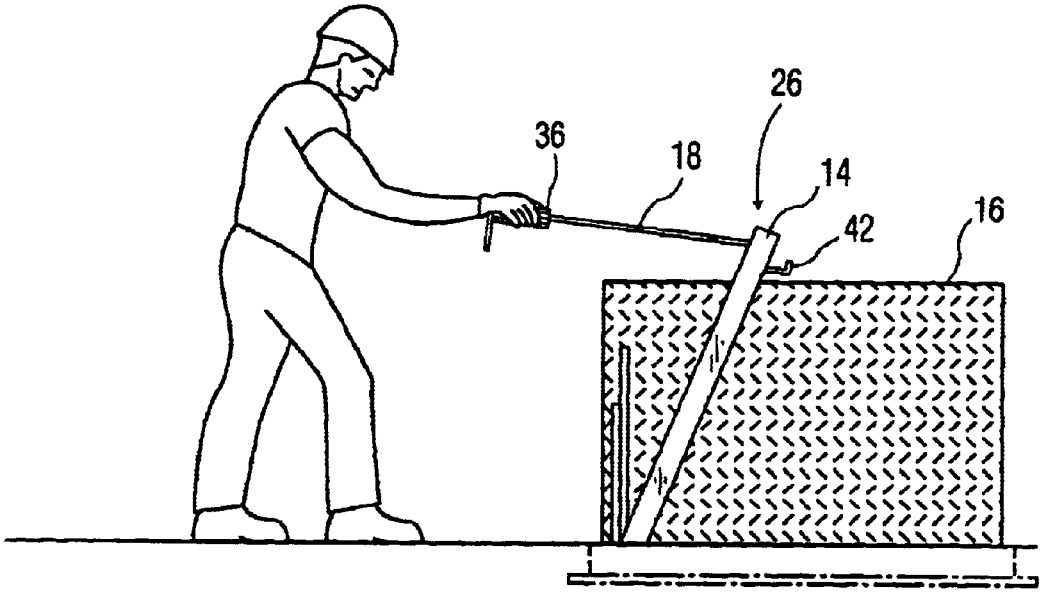
FIG. 6B is diagrammatic view, illustrating how the pull arm allows a worker to stand at a safe location while opening or closing the grate of FIG. 1.
Figure 6C:
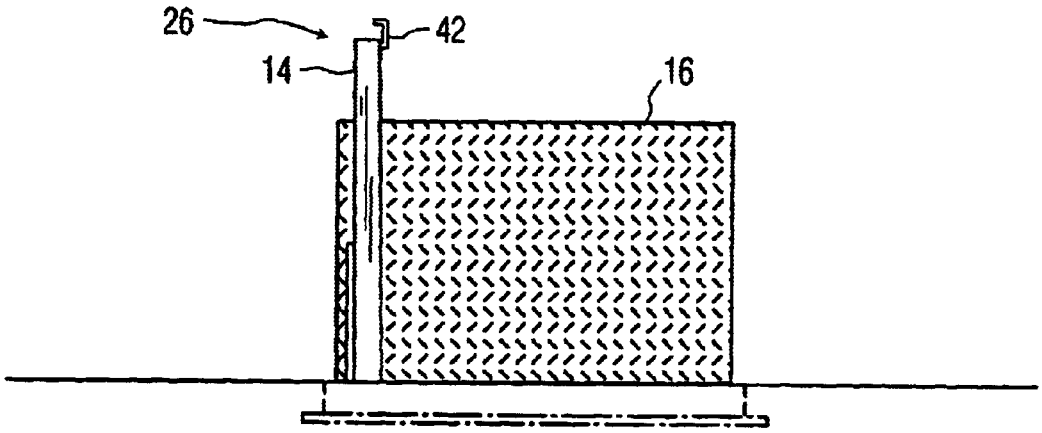
FIG. 6C is diagrammatic view, showing the grate of the hatch in FIG. 1 in an open position.

As shown in FIG. 1 and illustrated in FIG. 6C, grate 14 and cover 16 are mounted at substantially right angles to each other on frame 12. FIG. 6C shows both cover 16 and grate 14 in their respective open positions. Note that, in these positions, grate 14 obstructs the rotational path of cover 16 between the open and closed positions of the cover. In these positions, grate 14 prevents cover 16 from being moved to the closed position (i.e., grate 14 prevents closure of hatch 10). Cover 16 is free to close once grate 14 is moved to its closed position (FIG. 1). This arrangement of cover and grate is a safety feature of hatch 10. It achieves the objective that the fall-through protection (i.e., grate 14) will be in-place for the next worker who opens the hatch.

Another safety feature concerns the arrangement of pull arm 18 on grate 14. Pull arm 18 prompts or encourages a worker to stand at a safe location when opening and closing the hatch. This feature is demonstrated in FIGS. 6A and 6B. Pull arm 18 is mounted at far side 26 of grate 14—the side that needs to be lifted when opening grate 14. Pull arm 18 extends to near side 24 of grate 14, which is away from any exposure to hatch opening 20. The location of handle 36 (when the pull arm is in the rest position) naturally prompts a worker to stand adjacent to near side 24—a safe location when opening grate 14 (i.e., the fall-through protection). This "prompting" function is enhanced if handle 36 has a conspicuous color, such as bright orange or red.

The length of pull arm 18 is appropriately sized in accordance with the length of grate 14. An appropriate length for pull arm 18 ensures that the worker does not have to bend over hatch opening 20 while opening grate 14 (FIGS. 6A–6B). In addition, if the worker should lose his or her balance while opening grate 14, any fall towards hatch 10 would normally result in grate 14 being closed ahead of the worker's fall. The momentum of the worker's body, acting on pull arm 18 and thus grate 14, would cause the grate to close before the worker fell onto the hatch.

Figure 7:
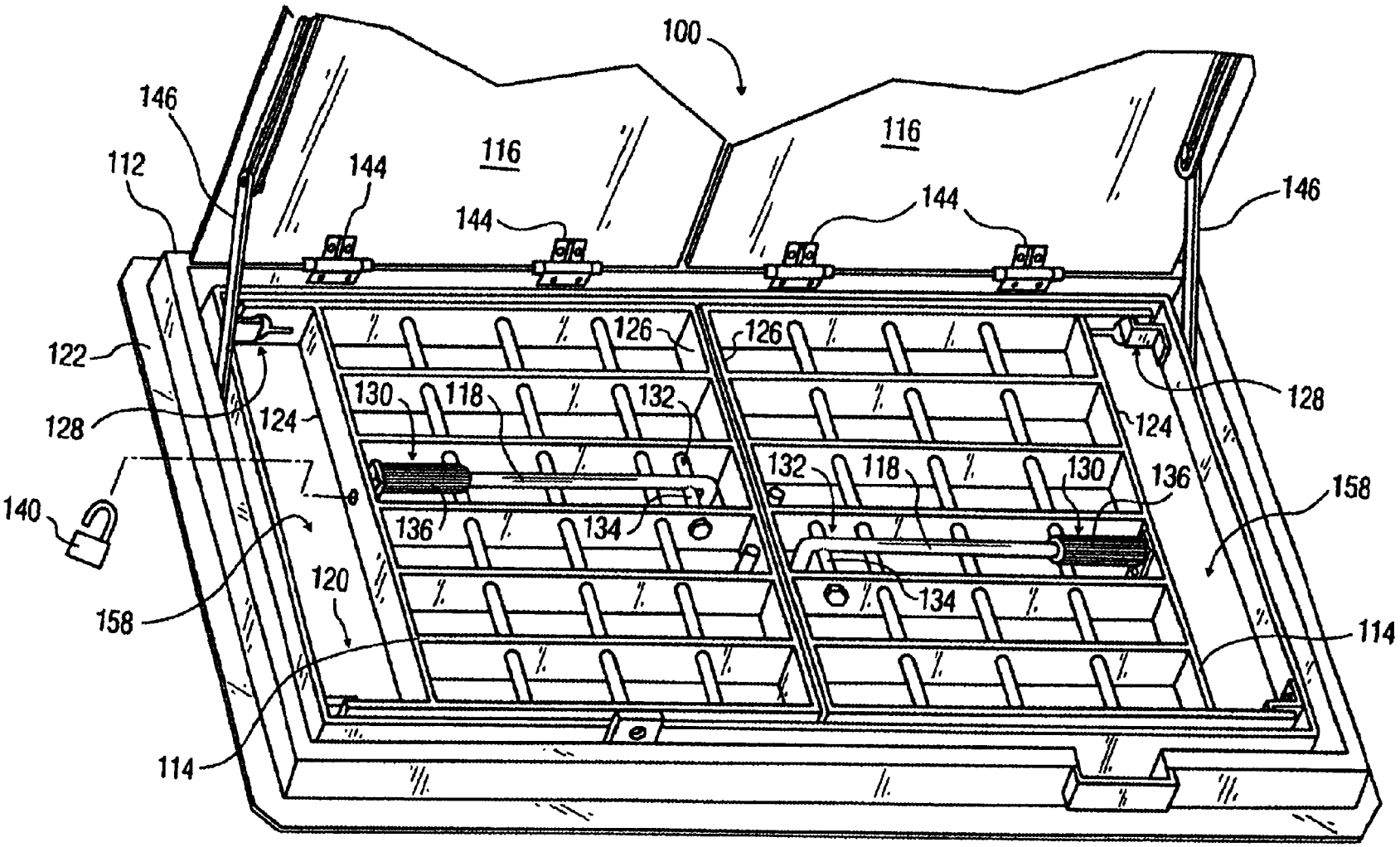
FIG. 7 is a perspective view of a double-leaf access hatch, constructed in accordance with the present invention.
Figure 8:
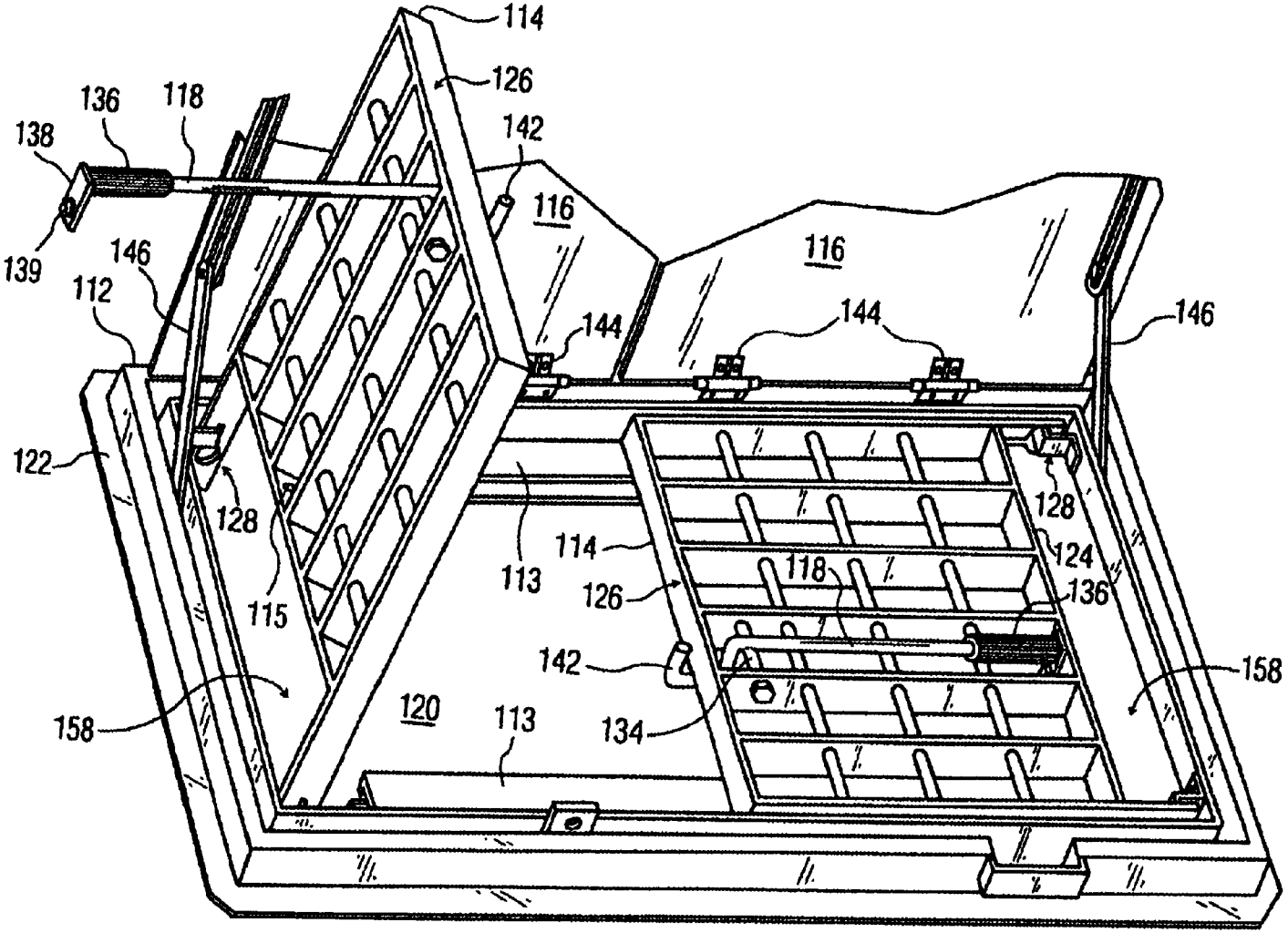
FIG. 8 is a perspective view of the double-leaf access hatch of FIG. 7, showing one of the grates in an open and locked position with its associated pull arm extended from a rest position.

Referring now to FIGS. 7 and 8, there is shown a double-leaf access hatch 100, constructed in accordance with the present invention. Hatch 100 comprises a channel-type frame 112, a pair of grates 114, a pair of covers 116, and a pull arm 118 mounted to each grate. Frame 112 contains an access opening 120 and an anchor flange 122. Frame 112 functions and is installed in the same manner as frame 12. Frame 112 is essentially of the same construction as frame 12 except, rather than having a channeled rail 13 at one end, frame 112 has a pair of channeled rails 113 (which are preferably uni-strut nut rails), welded or bolted along the interior front and rear sides of the frame (See FIG. 8). These rails provide a bearing or supporting surface for grates 114.

Each grate 114 has a near (or hinged) side 124 and a far (or free) side 126. Near side 124 of each grate is pivotally coupled to frame 112 by way of a pair of locking hinges 128. Hinges 128 are constructed and operate in the same manner as hinges 28, as described above. Hinges 128 permit pivotal movement of grates 114 between closed (FIG. 7) and open (FIG. 8) positions. These positions are the same as described with respect to grate 14 (FIGS. 1 and 3). Each pair of hinges 128 causes their associated grate 114 to be locked in the open position (See FIG. 8). Once locked in the open position, grates 114 provide secure barriers between workers and hatch opening 120. Grates 114 are unlocked from their open positions by raising the grates (this disengages the locking hinges). Upon disengagement, grates 114 are free to pivot between the open and closed positions. Grates 114 are constructed and operate in essentially the same manner as grate 14.

As shown in FIGS. 7 and 8, each pull arm 118 has a proximal end 130 and a distal end 132. Distal ends 132 are pivotally coupled to grates 114, respectively, by way of a hinge bar 134. Hinge bars 134 are rotatably mounted in grates 114 in the same manner has hinge bar 34. At their proximal ends 130, pull arms 118 each have a vinyl grip handle 136. Preferably, handles 136 have a conspicuous color, such as red or orange. In FIG. 7, pull arms 118 are shown in the rest position. Each pull arm 118 is normally in the rest position when its associated grate 114 is in the closed position. In the rest position, proximal ends 130 extend substantially to near sides 124 of grates 114, respectively. Each proximal end 130 is manually moveable away from its associated grate 114, from the rest position.

Pull arms 118 are constructed in the same manner as pull arm 18. As shown in FIG. 8, each pull arm 118 has an eyelet member 138 containing an eyelet or bore 139. Grates 114 each contain a hole 115. The bore of eyelet 138 aligns with hole 115 when pull arm 118 is in the rest position. This allows for a padlock 140 (FIG. 7), or some other locking fastener, to be inserted through aligned hole 115 and bore 139, to lock the pull arm to the grate. As best shown in FIG. 8, each pull arm 118 includes a catch 142 extending from distal end 132. As shown by FIGS. 7 and 8, the catch associated with one grate engages the other grate in an interlocking manner. Catch 142 functions to check the movement of its associated grate when both grates 114 are in the closed position and the pull arm, with which the catch is associated, is in the rest position. When both pull arms 118 are locked to their associated grates 114 (e.g., with a padlock), the grates will be locked in the closed position, thus preventing unauthorized entry through hatch 100.

As shown in FIGS. 7 and 8, each cover 116 is mounted to frame 112 by a pair of hinges 144. Hinges 144 are bolted to covers 116 and frame 112. Hinges 144 permit pivotal movement of the covers between open (FIGS. 7 and 8) and closed positions (over the frame) Each cover 116 is supported in the open position by a hold-open arm 146. Arms 146 are constructed and operate in the same manner as hold-open arm 46 described above. As with the single-leaf hatch, the preferred open position for covers 116 is approximately 90 degrees from the plane of frame opening 120. The construction and features of covers 116 are essentially the same as cover 16.

As with the single-leaf hatch, the near side 124 of each grate 114 is spaced apart from frame 112, so as to define a limited access opening 158. Openings 158 improve visibility through the grates and allow workers to reach through the grates to perform certain adjustments or maintenance on apparatus inside the installation (without opening grates 114). In some cases, certain apparatus can be brought up through openings 158 for repair or adjustment outside the installation (without opening grates 114).

As best shown in FIG. 8, grates 114 are mounted at right angles to covers 116, on frame 112. As illustrated in FIG. 8, when grates 114 are in the open position, they will obstruct the rotational path of covers 116 between the open and closed positions of the covers. Grates 114 prevent covers 116 from being moved to the closed position (i.e., grates 114 prevent closure of hatch 100). Covers 116 are free to close once grates 114 are moved to their closed position (FIG. 7). This arrangement achieves the objective that the fall-through protection (i.e., grates 114) will be in-place for the next worker who opens hatch 100.

As with the single-leaf hatch 10, the arrangement of pull arms 118 on grates 114 prompts or encourages workers to stand at near sides 124—safe locations when opening grates 114, respectively. The length of pull arms 118 ensures that workers do not have to bend or reach over access opening 120 while opening grates 114. As with the pull arm in hatch 10, if a worker loses his or her balance while opening one of grates 114, the momentum of the worker's body, acting on the pull arm and thus the grate, would cause the grate to close before the worker fell onto the hatch.

Figure 9:
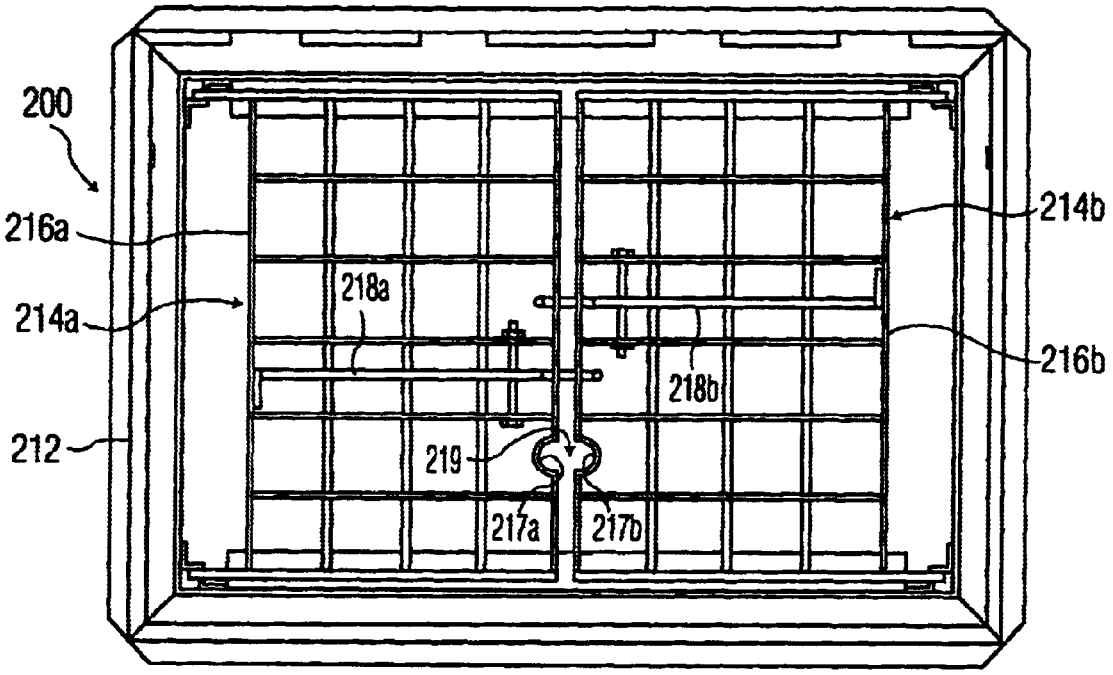
FIG. 9 is a top plan view of a second embodiment of a double-leaf access hatch, constructed in accordance with the present invention.
Figure 10:
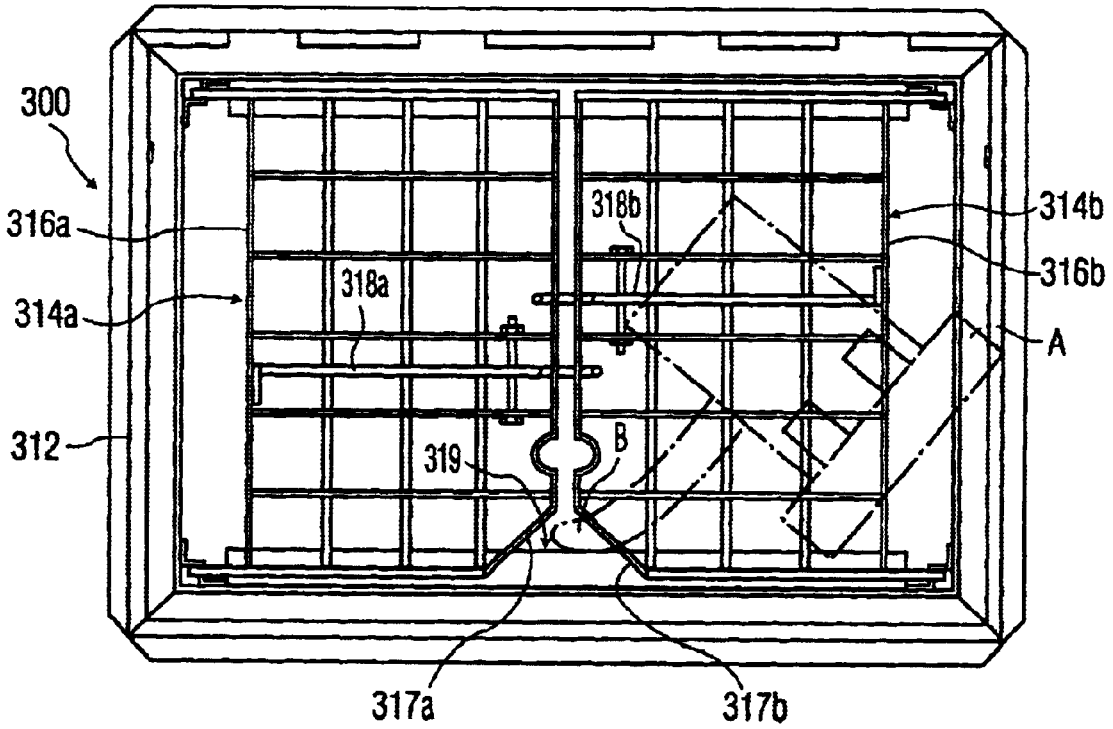
FIG. 10 is a top plan view of a third embodiment of a double-leaf access hatch, constructed in accordance with the present invention.

Referring now to FIGS. 9 and 10, there is shown top plan views of double-leaf hatches 200 and 300, respectively, constructed in accordance with the present invention. Hatches 200 and 300 are constructed and operate essentially as described with respect to hatch 100. Hatches 200 and 300 are shown without their hatch covers, however, because the focus of this discussion is on the grates and the ability of the grates to close when apparatus, connected to a utility line (e.g., cable or hose), is brought up through the hatch for maintenance.

As shown in FIG. 9, hatch 200 includes a frame 212, grates 214*a* and 214*b*, and pull arms 218*a* and 218*b* mounted to grates 214*a* and 214*b*, respectively. Grates 214*a* and 214*b* are bounded by perimeters 216*a* and 216*b*, respectively. Perimeters 216*a* and 216*b* are defined as the outermost structure of its associated grate, which structure surrounds the grid of bars making up the grate. As shown in FIG. 9, perimeter 216*a* contains a recessed portion 217*a*, and perimeter 216*b* contains a recessed portion 217*b*. In the example shown in FIG. 9, recessed portions 217*a* and 217*b* form or define a utility opening 219 when the grates are closed.

Utility opening 219 allows grates 214*a* and 214*b* to be closed after an apparatus, connected to a "utility line," is brought up through hatch 200 for maintenance, cleaning or repair, etc (See FIG. 10). A "utility line" is any flexible line or tether attached to an apparatus, such as, e.g., an electrical cable, steel cable, rope, gas line, water line, hose, strap, and the like. Grates 214*a* and 214*b* are opened to allow an apparatus, connected to a utility line, to be brought up through hatch 200. Once the apparatus is brought up, grates 214*a* and 214*b* can closed, because the utility line is allowed to pass through utility opening 219 (See FIG. 10, as to hatch 300). The apparatus can be placed on closed grates 214*a* and 214*b* for maintenance, cleaning or repair work.

Referring now to FIG. 10, hatch 300 includes a frame 312, grates 314*a* and 314*b*, and pull arms 318*a* and 318*b* mounted to grates 314*a* and 314*b*, respectively. Grates 314*a* and 314*b* have perimeters 316*a* and 316*b*, respectively. Perimeter 316*a* contains a recessed portion 317*a*, and perimeter 316*b* contains a recessed portion 317*b*. In this example, recessed portions 317*a* and 317*b*, together with frame 312, define a utility opening 319 when the grates are closed. Utility opening 319 allows grates 314*a* and 314*b* to be closed after an apparatus A, connected to a utility line B, is brought up through hatch 300 for maintenance, cleaning or repair, etc.

It is to be understood that the utility opening can be implemented in ways other than as shown in FIGS. 9 and 10. For example, in FIG. 9, recessed portion 217*a* (dimensioned appropriately) could form the utility opening with an unrecessed perimeter 216*b*. Similarly, in FIG. 10, recessed portion 317*a* could form the utility opening with frame 312 and an unrecessed perimeter 316*b*. In another embodiment, a single recessed portion could form a utility opening with the hatch frame. In a further embodiment, a utility opening could be implemented in a single-leaf hatch, such as hatch 10. In such case, a recessed portion contained in the perimeter of grate 14 could form such a utility opening with frame 12.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

What we claim is:

1. An access hatch, comprising:

a frame containing an access opening therethrough;

a grate having a near side and a far side;

a hinge non-removably coupling the near side of said grate to said frame for pivotal movement of said grate between a closed and an open position, in the closed position said grate lies substantially in the access opening of said frame and blocks at least a portion of the opening, and in the open position said grate is oriented away from the opening of said frame to allow access through the opening, said hinge including a link member having a slotted section which allows said grate to drop to a lock position when said grate is in the open position, said grate being prevented from moving to the closed position when said grate is in the lock position; and a pull member having a proximal end and a distal end, the distal end being pivotally coupled to said grate near the far side of said grate, the proximal end extending substantially to the near side of said grate when said pull member is in a rest position, said pull member being normally in the rest position when said grate is in the closed position, whereby a worker, intending to open said grate, is prompted to stand at the near side of said grate and grasp the proximal end of said pull member to pull said grate to the open position.

2. The access hatch of claim 1, further comprising:

a cover mounted to said frame for pivotal movement between an open position away from said frame and a closed position over said frame, said grate and said cover being disposed on said frame such that the movement of said cover from the open position to the closed position is obstructed by said grate when said grate is in the open position and is clear of said grate when said grate is in the closed position, whereby said cover cannot be closed until said grate is closed, thus providing fall-through protection for the worker opening said cover.

3. The access hatch of claim 2, wherein said grate and said cover are mounted at substantially right angles to each other on said frame.

4. The access hatch of claim 1, wherein said pull member further includes catch means extending from the distal end of said pull member, for checking the pivotal movement of said grate when said grate is in the closed position and said pull member is in the rest position.

5. The access hatch of claim 1, wherein said pull member further includes an eyelet at the proximal end of said pull member, and further comprising a padlock, the eyelet for receiving the padlock to lock said pull member in the rest position.

6. The access hatch of claim 5, wherein said grate contains a hole which is aligned with the eyelet of said pull member when said pull member is in the rest position.

7. The access hatch of claim 6, wherein the padlock is removably secured through the aligned hole and said eyelet.

8. The access hatch of claim 1, wherein said hinge is a locking hinge and wherein said link member is a female link member, said hinge further including a male link member coupled to the female link member, one of said link members being rotatable relative to the other of said link members, the male link member lockingly engaging the female link member at a locking point of rotation of the one of said link members, said link members being oriented relative to said frame and said grate such that the locking point of rotation occurs when said grate is in the open position, whereby said grate is rotatable between the closed and the open positions, and said grate is in the lock position upon engagement of the male and the female link members of said hinge.

9. The access hatch of claim 1, wherein the near side of said grate is spaced apart from said frame so as to define a limited access opening between said frame and said grate, such that limited access through said frame is permitted when said grate is in the closed position.

10. The access hatch of claim 1, wherein said pull member contains a bore at the proximal end thereof, and wherein said grate contains a hole which is aligned with the bore when said pull member is in the rest position, such that a fastener is able to be inserted through the aligned hole and bore to lock said member to said grate.

11. The access hatch of claim 1, wherein said grate includes a perimeter containing a recessed portion, the recessed portion forming a utility opening with said frame when said grate is in the closed position, whereby an apparatus connected to a utility line is permitted to pass through the access opening of said frame when said grate is in the open position, and is permitted to rest on top of said grate when said grate is in the closed position, the utility line extending through the utility opening.

12. The access hatch of claim 1, wherein said pull member further includes means, attached to the proximal end of said member, for receiving a fastener to lock said member in the rest position.

13. The access hatch of claim 1, wherein said pull member further includes a catch extending from the distal end of said pull member, said catch engaging said frame when said grate is in the closed position and said pull member is in the rest position, such that said grate is checked in the closed position.

14. The access hatch of claim 1, further comprising:

a second grate having a near side and a far side, the near side of said second grate being coupled to said frame for pivotal movement of said second grate between a closed and an open position, in the closed position said second grate lies substantially in the access opening of said frame and blocks a portion of the opening, and in the open position said second grate is oriented away from the opening of said frame to allow access through the opening; and a second pull member having a proximal end and a distal end, the distal end being pivotally coupled to said second grate near the far side of said grate, the proximal end extending substantially to the near side of said second grate when said second pull member is in a rest position, said second pull member being normally in the rest position when said second grate is in the closed position, whereby the worker, intending to open said second grate, is prompted to stand at the near side of said second grate and grasp the proximal end of said second pull member to pull said second grate to the open position.

15. An access hatch, comprising:

a frame containing an access opening therethrough;

first and second grates, each having a near side and a far side, each of the near sides being coupled to said frame for pivotal movement of said grates between respective closed and open positions, in their respective closed positions said grates lie substantially in the access opening of said frame, and in their respective open positions said grates are oriented away from the opening of said frame to allow access through the opening, the opening being substantially blocked when both of said grates are in their respective closed positions; and first and second pull members, each having a proximal end and a distal end, the distal ends of said first and said second pull members being pivotally coupled to said first and said second grates, respectively, near the far side of said grates, the proximal ends of said first and said second pull members extending substantially to the near sides of said first and said second grates, respectively, when said pull members are in a rest position, said first and said second pull members being normally in the rest position when said first and said second grates, respectively, are in the closed position, said first pull member including a catch extending from the distal end of said first pull member, said catch engaging said second grate when said first and said second grates are in their closed positions and said first pull member is brought to the rest position, whereby said first grate is checked in the closed position.

16. The access hatch of claim 15, wherein said second pull member includes a catch extending from the distal end of said second pull member, said catch engaging said first grate when said first and said second grates are in their closed positions and said second pull member is brought to the rest position, whereby said second grate is checked in the closed position.

17. An access hatch, comprising:

a frame containing an access opening therethrough;

first and second grates, each having a near side and a far side;

first and second hinges non-removably coupling the near sides of said first and said second grates, respectively, to said frame for pivotal movement of said grates between respective closed and open positions, in their respective closed positions said grates lie substantially in the access opening of said frame and in their respective open positions said grates are oriented away from the opening of said frame to allow access through the opening, the opening being substantially blocked when both of said grates are in their respective closed positions, said first hinge including a link member configured to allow said first grate to drop to a lock position when said first grate is in the open position, said first grate being prevented from moving to the closed position when said first grate is in the lock position; and first and second pull members, each having a proximal end and a distal end, the distal ends of said first and said second pull members being pivotally coupled to said first and said second grates, respectively, near the far side of said grates, the proximal ends of said first and said second pull members extending substantially to the near side of said first and said second grates, respectively, when said pull members are in a rest position, said first and said second pull members being normally in the rest position when said first and said second grates are in their respective closed positions, whereby a worker, intending to open one of said grates, is prompted to stand at the near side of said one grate and grasp the proximal end of the pull member of said one grate, to pull said one grate to the open position.

18. The access hatch of claim 17, wherein said first pull member includes a catch extending from the distal end of said first pull member, said catch engaging said second grate when said first and said second grates are in their closed positions and said first pull member is brought to the rest position, whereby said first grate is checked in the closed position.

19. The access hatch of claim 18, wherein said second pull member includes a catch extending from the distal end of said second pull member, said catch engaging said first grate when said first and said second grates are in their closed positions and said second pull member is brought to the rest position, whereby said second grate is checked in the closed position.

20. The access hatch of claim 17, wherein each of said first and said second grates includes a perimeter, the perimeter of said first grate contains a recessed portion which forms a utility opening with said frame when said first grate is in the closed position, whereby an apparatus connected to a utility line is permitted to pass through the access opening of said frame when at least one of said grates is in the open position, and is permitted to rest on top of at least one of said grates when said grates are in their closed positions, the utility line extending through the utility opening.

21. The access hatch of claim 17, wherein each of said first and said second grates includes a perimeter, the perimeter of said first grate contains a recessed portion which forms a utility opening with said frame and the perimeter of said second grate when said first and said second grates are in the closed position, whereby an apparatus connected to a utility line is permitted to pass through the access opening of said frame when at least one of said grates is in the open position, and is permitted to rest on top of at least one of said grates when said grates are in their closed positions, the utility line extending through the utility opening.

22. The access hatch of claim 21, wherein the perimeter of said second grate contains a recessed portion, the utility opening being formed by the recessed portions of said first and said second grates and said frame.

23. The access hatch of claim 17, wherein each of said first and said second grates includes a perimeter, the perimeter of said first grate contains a recessed portion which forms a utility opening with the perimeter of said second grate when said first and said second grates are both in the closed position, whereby an apparatus connected to a utility line is permitted to pass through the access opening of said frame when at least one of said grates is in the open position, and is permitted to rest on top of at least one of said grates when said grates are in their closed positions, the utility line extending through the utility opening.

24. The access hatch of claim 23, wherein the perimeter of said second grate contains a recessed portion, the utility opening being formed by the recessed portions of said first and said second grates.

25. The access hatch of claim 17, wherein said first pull member includes catch means, extending from the distal end thereof, for checking the movement of said first grate when said first grate is in the closed position and said first pull member is in the rest position.

26. An access hatch, comprising:

a frame containing an access opening therethrough;

a grate having a near side, the near side of said grate being spaced apart from said frame to define a limited access opening between said frame and said grate; and a locking hinge non-removably coupling the near side of said grate to said frame for pivotal movement of said grate between a closed and an open position, in the closed position said grate lies substantially in the access opening of same frame and blocks at least a portion of the opening, and in the open position said grate is oriented away from the opening of said frame to allow access through the opening, said locking hinge having a male link member coupled to a female link member, one of said link members being rotatable relative to the other of said link members, said locking hinge further having means for locking the male link member with the female link member at a locking point of rotation of the one of said link members, said link members being oriented relative to said frame and said grate such that the locking point of rotation occurs when said grate is in the open position, whereby said grate is rotatable between the closed and the open positions, and said grate is locked in the open position upon engagement of the male link member with the female link member of said hinge.

27. An access hatch, comprising:

a frame containing an access opening therethrough;

first and second grates, each having a near side and a far side, each of the near sides being coupled to said frame for pivotal movement of said grates between respective closed and open positions, in their respective closed positions said grates lie substantially in the access opening of said frame, and in their respective open positions said grates are oriented away from the opening of said frame to allow access through the opening, the opening being substantially blocked when both of said grates are in their respective closed positions, said first grate containing a recessed portion, a utility opening being defined at least by—(a) the recessed portion, (b) said second grate, and (c) said frame when said first and said second grates are in the closed position, whereby an apparatus connected to a utility line is permitted to pass through the access opening of said frame when at least one of said grates is in the open position, and is permitted to rest on top of at least one of said grates when said grates are in their closed positions, the utility line extending through the utility opening; and first and second pull members, each having a proximal end and a distal end, the distal ends of said first and said second pull members being pivotally coupled to said first and said second grates, respectively, near the far side of said grates, the proximal ends of said first and said second pull members extending substantially to the near side of said first and said second grates, respectively, when said pull members are in a rest position, said first and said second pull members being normally in the rest position when said first and said second grates, respectively, are in the closed position, whereby a worker, intending to open one of said grates, is prompted to stand at the near side of said one grate and grasp the proximal end of the pull member of said one grate, to pull said one grate to the open position.

28. The access hatch of claim 27, wherein said second grate contains a recessed portion, the utility opening being defined at least by—(a) the recessed portion of said first grate, (b) the recessed portion of said second grate, and (c) said frame.

29. An access hatch, comprising:

a frame containing an access opening therethrough;

a grate having grate openings, a near side and a far side, the near side being coupled to said frame for pivotal movement of said grate between a closed and an open position, in the closed position said grate lies substantially in the access opening of said frame and blocks at least a portion of the opening while the grate openings allow visual inspection through the grate, and in the open position said grate is oriented away from the opening of said frame to allow access through the opening; and a pull member having a proximal end a distal end, the distal end being pivotally coupled to said grate near the far side of said grate, the proximal end extending substantially to the near side of said grate when said pull member is in a rest position, said pull member being normally in the rest position when said grate is in the closed position, said pull member further including a catch extending from the distal end of said pull member, said catch engaging said frame when said grate is in the closed position and said pull member is in the rest position such that said grate is checked in the closed position.

* * * * *